United States Patent [19]

Fastner

[11] 4,040,470

[45] Aug. 9, 1977

[54] METHOD OF CONTINUOUSLY CASTING STEEL

[75] Inventor: Thorwald Fastner, Linz, Austria

[73] Assignee: Vereinigte Osterreichische Eisen- und Stahlwerke-Alpine Montan Aktiengesellschaft, Linz, Austria

[21] Appl. No.: 657,727

[22] Filed: Feb. 13, 1976

[30] Foreign Application Priority Data

Mar. 5, 1975 Austria ..... 1685/75

[51] Int. Cl.[2] ..... B22D 11/10

[52] U.S. Cl. ..... 164/58; 164/57; 164/82

[58] Field of Search ..... 164/57, 58, 82

[56] References Cited

U.S. PATENT DOCUMENTS

| | | | |
|---|---|---|---|
| 3,704,744 | 12/1972 | Holley et al. | 164/82 |
| 3,822,735 | 7/1974 | Miltenberger et al. | 164/57 X |

FOREIGN PATENT DOCUMENTS

| | | | |
|---|---|---|---|
| 2,251,522 | 4/1974 | Germany | 164/57 |
| 2,321,847 | 11/1974 | Germany | 164/57 |
| 47-26939 | 1/1970 | Japan | 164/57 |

*Primary Examiner*—Ronald J. Shore

*Attorney, Agent, or Firm*—Brumbaugh, Graves, Donohue & Raymond

[57] ABSTRACT

In a method of continuously casting steel strands in continuous casting plants, casting powder admixed with at least one alloying component is continuously supplied to the casting level in the mold so that the alloying component is taken up by the strand surface.

5 Claims, 1 Drawing Figure

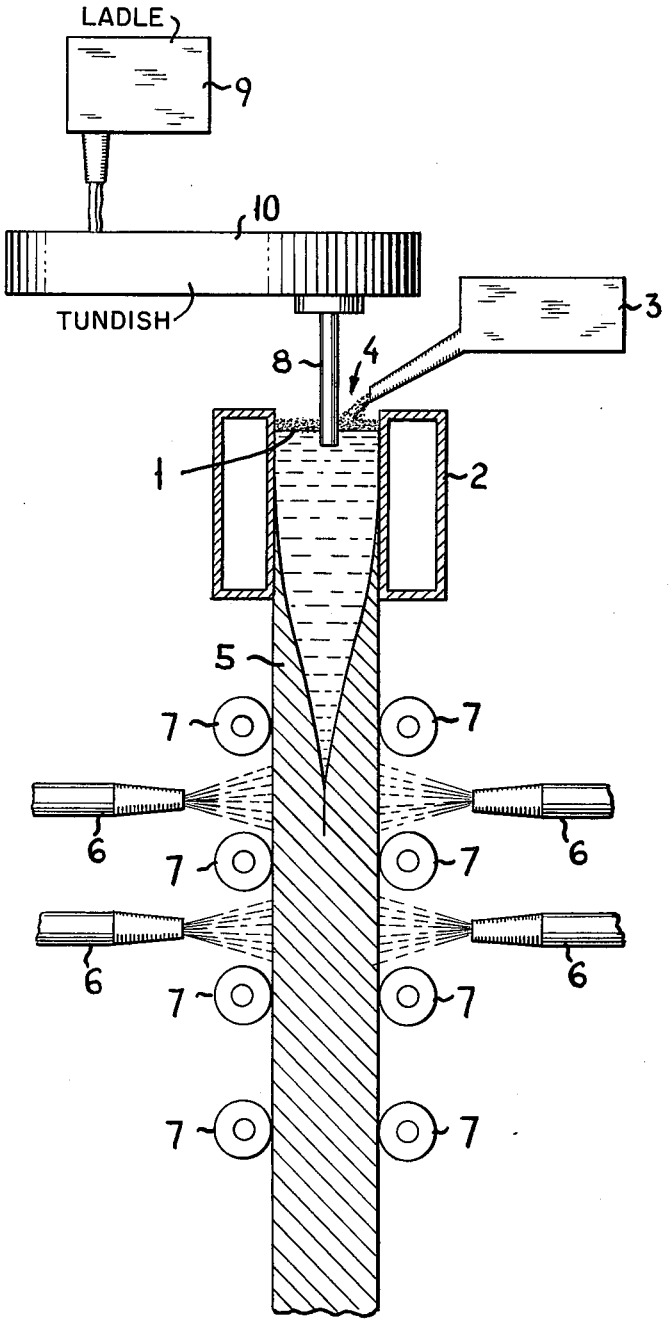
LADLE
9
10
TUNDISH
3
8
4
1
2
5
7
6

METHOD OF CONTINUOUSLY CASTING STEEL

BACKGROUND OF THE INVENTION

The invention relates to a method of continuously casting steel strands in continuous casting plants, wherein the steel is cast into the mould through one or more than one casting tubes reaching below the casting level in the mould and casting powder is continuously applied to the casting level in the mould.

Cracks in steel strands cause high losses of material and reduce the output advantage that the continuous casting process has relative to other casting processes. The cracks must be removed before the strand is processed, because otherwise the end product would have a surface that cannot be used.

There are various factors that cause cracks. They may form, e.g., because the strand guide does not correspond to the specified geometry. Then the strand is subjected to an increased deformation stress. Furthermore, tensions due to the water cooling of the strand increase the likelihood of the formation of cracks. Also the corrosion of the strand surface due to scales and casting slag contributes to the formation of cracks. Finally, the occurrence of cracks also essentially depends on the chemical composition of the material.

The above named influencing factors cannot be excluded, but they can be diminished to a certain extent, which requires a high degree of maintenance of the continuous casting plant and an exact observance of certain casting conditions. Despite such measures, however, there still remains the danger of the formation of cracks.

SUMMARY OF THE INVENTION

The invention aims at preventing the above described difficulties and has as its object to create a casting process wherein the steel strands can produced free from cracks as independently of the casting conditions as possible, and wherein the maintenance of the casting plant need not be so meticulous.

According to the invention, this object is achieved in a casting process of the above defined kind in that a casting powder is used that contains one or more than one of the alloying components to be taken up by the surface of the strand. Preferably, one or more than one of the following elements are used as alloying components: nickel, molybdenum and chromium, admixed with the casting powder.

Advantageously, the alloying components are added to the casting powder in an amount from at least 5% by weight to at most 70% by weight. It has proved to be especially advantageous to add the alloying components to the casting powder in a finely grained form having a maximum grain size of 3 mm, preferably having a maximum grain size of 1 mm.

BRIEF DESCRIPTION OF THE DRAWING

The foregoing and other features of the present invention will be more readily apparent from the following detailed description and drawing of an illustrative embodiment of the invention in which the sole FIGURE shows a sectional view of a continuous casting plant according to the present invention.

DESCRIPTION OF EXEMPLARY EMBODIMENTS

The casting powder 4 applied onto the casting level 1 in a mould 2 during casting, dissolves and flows off between the mould and the cast strand 5. In order to maintain a slag cover, casting powder is continuously supplied from a bin 3. If an alloying component is added to the casting powder, according to the invention, this alloying component is brought to the level of the bath because of the dissolving procedure of the casting powder, and there it comes into contact with the surface molten steel and alloys the steel in that area. Since the surface of the strand forms from the steel in the casting level area, the strand surface consists of alloyed strand; thus the steel is covered by alloyed steel on all sides. Of course, a part of the molten alloyed steel is also transported by the flow of the steel from the casting level into the interior of the strand. However, these amounts are small and do not lead to a recognizable change of in the analysis of the steel over the entire cross-section of the strand. Through the casting powder, a sufficient amount of alloying material is supplied so that the concentration of the alloy formed in the area of the casting level is maintained.

The required amount of alloying components is very small as compared to the amount of steel. For one metric ton of steel about 0.01 – 0.1 kg are needed. Such small amounts are not only advantageous for economic reasons, but also because the type of steel is not changed by the alloying addition.

The tendency of the formation of cracks can be largely eliminated by the elements nickel, molybdenum and chromium. Nickel and molybdenum increase the high-temperature strength, as is known. Chromium above all inhibits the corrosion. The above named elements are added to the casting powder in metallic form, in particular in the form of metal alloys. The melting point of such alloys is essentially higher than that of the casting powder, and thus they are only dissolved when they come into contact with the molten steel.

In order to reduce the crack-proneness of the strands, the casting powder should contain at least 5% by weight of the alloying element. Increasing contents increase the effect. However, not more than 70% by weight of the whole mixture should consist of alloying elements, because otherwise the flowing behaviour of the dissolved casting powder would be impaired, which could lead to casting difficulties. Then the alloying particles could no longer be dissolved by the steel in the amount in which they were supplied through the casting powder. The optimum content of alloying elements in the casting powder depends on the individual casting conditions. In practice, first a number of casting powders having increasing contents of alloying elements are tested and then the one is chosen in which a further increase of the alloying portion does not bring about a further improvement of the surface.

As has been said, the alloying of the surface according to this method suffices to make the strand sufficiently resistant to the formation of cracks at the surface. The layer on the surface of the strand, in which the alloying metal is enriched, can be so thin that it can be almost completely removed by scaling during further processing, and consequently does not have any influence upon the mechanical properties of the final product.

Any known casting powder can be used as a carrier for the alloying components. The powdered or grained alloying components are admixed to, and well blended with, the casting powder before use. The grain size of the alloying components ought to be as small as possible so that they dissolve immediately upon coming into contact with the molten steel. Advantageously, the particles should have a diameter that is smaller than 1 mm. Particles having a diameter exceeding 3 mm are to be separated.

In practice, the invention has proved to be very advantageous. Crack-prone steels, such as unalloyed steel having about 0.14% carbon and micro-alloyed steels, can be produced free from cracks with a high degree of reliability. Furthermore, not much attention has to be paid to the uniformity of the cooling. Individual clogged spraying nozzles 6 do not impair the quality. Also, an intensified cooling can be used for reducing the intensity of segregations without the danger of causing cracks. In addition the strand are much less sensitive to deviations from the specified strand guide. The strands produced by this method also have the advantage that they need to be flame scarfed in individual areas only - about 1% of the overall area. No recognizable flame scarfing loss could be found.

Example: Steel was cast on a continuous casting plant for slabs. The strand guide had been used for one year, so that signs of wear could already be found on the supporting rollers 7 of the strand guide. The steel was taken from a 50-metric-ton-converter in a ladle 9 and had the following composition: 0.14% by weight C, 0.09% by weight Si, 0.37% by weight Mn, 0.015% by weight P, 0.022% by weight S, 0.044% by weight Al, balance iron. The mould 2 was adjusted to a size of 1500 × 210 mm. The steel had a casting temperature of 1540° C and was introduced into the mould via an immersion tube 8 connected to a tundish 10 which was kept filled by ladle 9. The casting speed of the strand was 1.1 n/min. about 0.8 liters of water per kg steel were needed for the cooling of the strand in the secondary cooling zone, until it had solidified throughout. Casting powder containing the following components was supplied onto the casting level in the mould: 0.3% by weight $Fe_2O_3$, 29.0% by weight $SiO_2$, 6.9% by weight $Al_2O_3$, 22.0% by weight CaO, 0.4% by weight MgO, 2.3% by weight $Na_2O$, 12.0% by weight $CaF_2$, 7.8% by weight $C_{total}$, 19.3% by weight FeCr. The chromium content of the FeCr amounted to 72%. The grain size was less than 1 mm. about 0.7 kg casting powder were used for one metric ton of steel. The slabs produced needed to be cleaned only locally. There was no mentionable loss of material.

On the other hand, slabs cast under comparable conditions - but using a casting powder without a metal alloy, yet otherwise having the same composition -contained numerous cracks in the surface, which were due to the bad condition of the strand guide. In order to remove the cracks, the entire surface had to be flame scarfed, resulting in a 2% loss of material of.

Slabs cast under the same conditions, but by using a casting powder having about 25% by weight FeMo instead of the 19.3% by weight FeCr, yet otherwise having the same composition as above, also were generally free from surface cracks.

I claim:

1. In a method of continuously casting steel to form strands in continuous casting plants having at least one casting tube and a mould, the steel being cast into the mould through said at least one casting tube and the at least one casting tube reaching below a casting level formed in the mould wherein a casting powder is continuously supplied onto the casting level in the mould, the improvement comprising using a casting powder that contains at least one metal alloying component in metallic form to be taken up by the surface of the strand.

2. A method as set forth in claim 1, wherein as the at least one metal alloying component at least one of the elements nickel, molybdenum and chromium is used in metallic form, admixed to the casting powder.

3. A method as set forth in claim 1, wherein the at least one metal alloying component is added to the casting powder in a total amount of at least 5% by weight and at most 70% by weight.

4. A method as set forth in claim 1, wherein the at least one metal alloying component is provided in a finely grained form having a maximum grain size of 3 mm.

5. A method as set forth in claim 1, wherein the at least one metal alloying component is provided in a finely grained form having a maximum grain size of 1 mm.

* * * * *

UNITED STATES PATENT OFFICE

CERTIFICATE OF CORRECTION

Patent No. 4,040,470 Dated Aug. 9, 1977

Inventor(s) Thorwald Fastner

It is certified that error appears in the above-identified patent and that said Letters Patent are hereby corrected as shown below:

Col. 2, line 4, "The" should read --A--;

Col. 2, lines 15 & 16, "strand; thus the steel" should read --steel; thus the strand--;

Col. 2, line 20, "of in" should read --in--;

Col. 2, line 44, "element" should read --elements--;

Col. 3, line 18, "In addition the strand" should read --In addition, the strands--;

Col. 3, line 37, "n/min. about" should read --m/min. About--;

Col. 4, line 2, "about 0.7 kg" should read --About 0.7 kg of--;

Col. 4, line 12, delete "of" (second occurrence).

Signed and Sealed this

First Day of November 1977

[SEAL]

Attest:

RUTH C. MASON
Attesting Officer

LUTRELLE F. PARKER
Acting Commissioner of Patents and Trademarks